US008422930B2

(12) United States Patent
Hurst et al.

(10) Patent No.: US 8,422,930 B2
(45) Date of Patent: Apr. 16, 2013

(54) SAFE RADIANT TONER HEATING APPARATUS WITH MEMBRANE

(75) Inventors: James H. Hurst, Rochester, NY (US); Andrew Ciaschi, Pittsford, NY (US); Donald S. Rimai, Webster, NY (US); Carl I. Bouwens, Leroy, NY (US)

(73) Assignee: Eastman Kodak Company, Rochester, NY (US)

( * ) Notice: Subject to any disclaimer, the term of this patent is extended or adjusted under 35 U.S.C. 154(b) by 438 days.

(21) Appl. No.: 12/731,178

(22) Filed: Mar. 25, 2010

(65) Prior Publication Data

US 2011/0236093 A1 Sep. 29, 2011

(51) Int. Cl.
*G03G 15/20* (2006.01)

(52) U.S. Cl.
USPC ..... 399/336; 399/69; 219/216

(58) Field of Classification Search ..... 399/33, 399/67, 69, 320, 335, 336; 219/216
See application file for complete search history.

(56) References Cited

U.S. PATENT DOCUMENTS

| | | | | | |
|---|---|---|---|---|---|
| 3,922,520 | A | | 11/1975 | Moore | |
| 3,953,709 | A | | 4/1976 | Elter | |
| 4,019,054 | A | * | 4/1977 | Saito et al. | 250/319 |
| 4,163,892 | A | * | 8/1979 | Komatsu et al. | 219/216 |
| 4,355,225 | A | | 10/1982 | Marsh | |
| 4,435,637 | A | | 3/1984 | de Vries | |
| 4,627,813 | A | | 12/1986 | Sasaki | |
| 4,994,642 | A | * | 2/1991 | Matsumoto et al. | 219/388 |
| 5,521,688 | A | | 5/1996 | Moser | |
| 5,526,108 | A | | 6/1996 | Billet et al. | |
| 5,602,635 | A | * | 2/1997 | Domoto et al. | 399/328 |
| 5,774,763 | A | * | 6/1998 | Muramatsu | 399/69 |
| 6,259,887 | B1 | * | 7/2001 | Awano | 399/390 |
| 6,449,458 | B1 | | 9/2002 | Lang et al. | |
| 6,661,993 | B2 | * | 12/2003 | Bartscher et al. | 399/341 |
| 6,674,990 | B2 | * | 1/2004 | Rohde et al. | 399/336 |
| 6,930,293 | B2 | | 8/2005 | Matsuo et al. | |
| 6,940,044 | B2 | * | 9/2005 | Eskey | 219/216 |
| 7,092,664 | B2 | * | 8/2006 | Bartscher et al. | 399/320 |
| 7,271,371 | B2 | | 9/2007 | Takematsu et al. | |
| 2009/0021550 | A1 | | 1/2009 | Leighton et al. | |

OTHER PUBLICATIONS

HP Product Web site at http://h10010.www1.hp.com/wwpc/us/en/sm/WF05a/18972-18972-3328060-15077-3328071-409994.html Featuring HP Color LaserJet 5550 Printer series, Overview and Features.

* cited by examiner

*Primary Examiner* — David Gray
*Assistant Examiner* — Thomas Giampaolo, II
(74) *Attorney, Agent, or Firm* — Christopher J. White

(57) ABSTRACT

Apparatus for heating toner on a receiver having an ignition energy, having an energy source for providing input energy; and a membrane disposed adjacent to the receiver. The membrane receives the input energy from the energy source; stores a portion of the input energy; and radiates emitted energy that is absorbed by the toner, the receiver, or a combination thereof, wherein the absorption causes the temperature of the toner to rise above a desired temperature. The stored portion of the input energy is less than the ignition energy.

3 Claims, 8 Drawing Sheets

SAFE RADIANT TONER HEATING APPARATUS WITH MEMBRANE

FIELD OF THE INVENTION

This invention pertains to the field of electrophotographic printing and more particularly to heating or fixing of toner on receivers.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, toner particles are given a charge substantially opposite to the charge of the latent image, and brought into the vicinity of the photoreceptor so as to be attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver through a fuser which provides heat to fix the print image to the receiver. However, if the receiver transport is interrupted and the receiver is left stationary close to a heat source, the receiver can be damaged or ignite, possibly causing damage and injury. Various schemes have been proposed to mitigate these dangers.

Moore, in U.S. Pat. No. 3,922,520, describes a radiant fuser including heating elements surrounded by a high-heat-capacity material in a housing. To fuse, the housing opens, and the stored heat from the high-heat-capacity material, and energy provided by the heating elements directly to the receiver, heat the receiver to melt the toner of the print image thereon. However, this scheme requires mechanically closing the housing when the receiver is stationary near the fuser, which increases the risk of damage to the filaments of lamps used as heating elements.

Billet et al., in U.S. Pat. No. 5,526,108, describe a radiant fuser having radiant sources mounted in hinged housings. The housings close to shield a stationary receiver from energy produced by the radiant sources. However, this scheme requires complex mechanical systems to move the panels. Furthermore, receiver stoppages are unexpected events, so the motion must be swift to reduce danger. Sudden motions can damage the radiant energy sources.

Both of these techniques require mechanical motion to shield the receiver from the energy source. The tracks on which mechanical parts ride can wear or gum, bearings can freeze, springs can break, and in other ways these mechanical systems can become unable to perform their safety functions. Furthermore, in all of these schemes, loss of electrical power to control the safety functions can result in the failure of those safety functions to protect the receiver.

There is a continuing need, therefore, for an improved toner heating device which does not require mechanical motion or electrical power to safeguard against damage and injury due to overheating of receivers.

SUMMARY OF THE INVENTION

According to the present invention, there is provided an apparatus for heating toner on a receiver having an ignition energy, comprising:

a. an energy source for providing input energy;

b. a membrane disposed adjacent to the receiver and adapted to:

i. receive the input energy from the energy source;

ii. store a portion of the input energy; and iii. radiate emitted energy that is absorbed by the toner, the receiver, or a combination thereof; wherein the absorption causes the temperature of the toner to rise above a desired temperature; and c. wherein the stored portion of the input energy is less than the ignition energy.

An advantage of this invention is that it contains no moving parts. Its safety functions are intrinsic and are not subject to failure due to temperature, humidity, rust, corrosion, thickening of lubricant, seizing of bearings, or other common mechanical failures. This invention is robust against vibration and damage in transit. The invention is capable of preheating or fusing toner, or both alternately. It is readily adaptable to various printer configurations. It can be used for simplex or duplex operation. In the event of a power loss, no damage or injury will occur to persons or property. The invention is capable of fusing toner stacks of various thicknesses.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
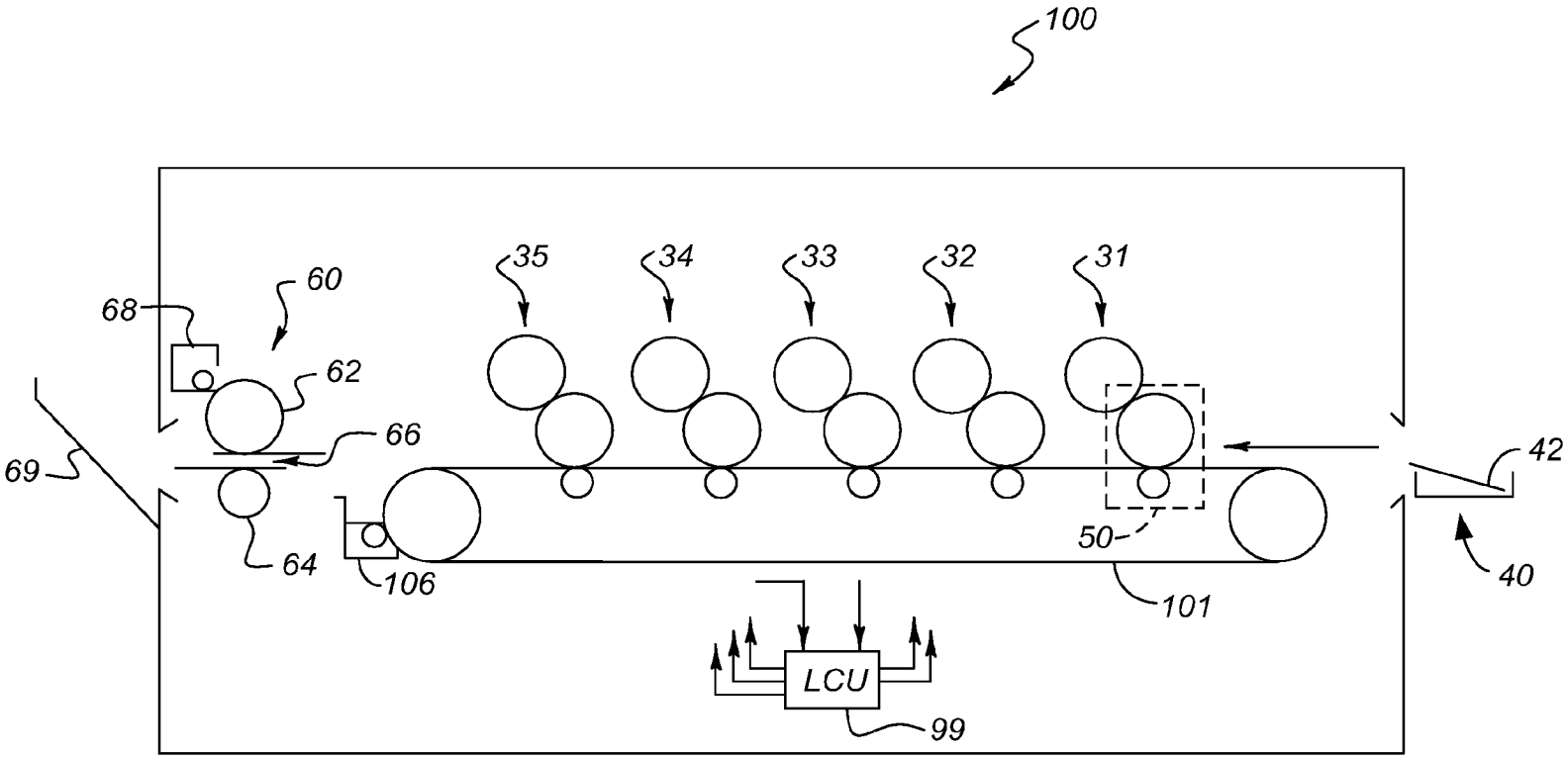
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, photoconductor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture of toner and magnetic carrier particles, which can be electrically-conductive or -non-conductive. Toner particles can be magnetic or non-magnetic. The carrier particles can be larger than the toner particles, e.g. 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography, printing using electrostatic fields, which is a subset of electrography, printing using electric fields.

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce original pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the Nexpress 2100 printer manufactured by Eastman Kodak Company of Rochester, N.Y., color-toner print images are made sequentially in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver of individual print images. Of course, in other electrophotographic printers, each print image is directly transferred to a receiver.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be processed as a combination of CMYK colors (e.g. metallic, fluorescent, or pearlescent colors), or a clear toner.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 101 transports the print-image-carrying receivers to fuser 60, which fixes the toner particles to the respective receivers by the application of heat and pressure. The receivers are serially de-tacked from transport web 101 to permit them to feed cleanly into fuser 60. Transport web 101 is then reconditioned for reuse at cleaning station 106 by cleaning and neutralizing the charges on the opposed surfaces of the transport web 101.

Fuser 60 includes a heated fusing roller 62 and an opposing pressure roller 64 that form a fusing nip 66 therebetween. Fuser 60 also includes a release fluid application substation 68 that applies release fluid, e.g. silicone oil, to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers carrying the fused image are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

Printer 100 includes a main printer apparatus logic and control unit (LCU) 99, which receives input signals from the various sensors associated with printer 100 and sends control signals to the components of printer 100. The LCU can include a microprocessor incorporating suitable look-up tables and control software executable by the LCU 99. It can also include a field-programmable gate array (FPGA), programmable logic device (PLD), microcontroller, or other digital control system. The LCU can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for imaging substrates. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R) respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Figure 2:
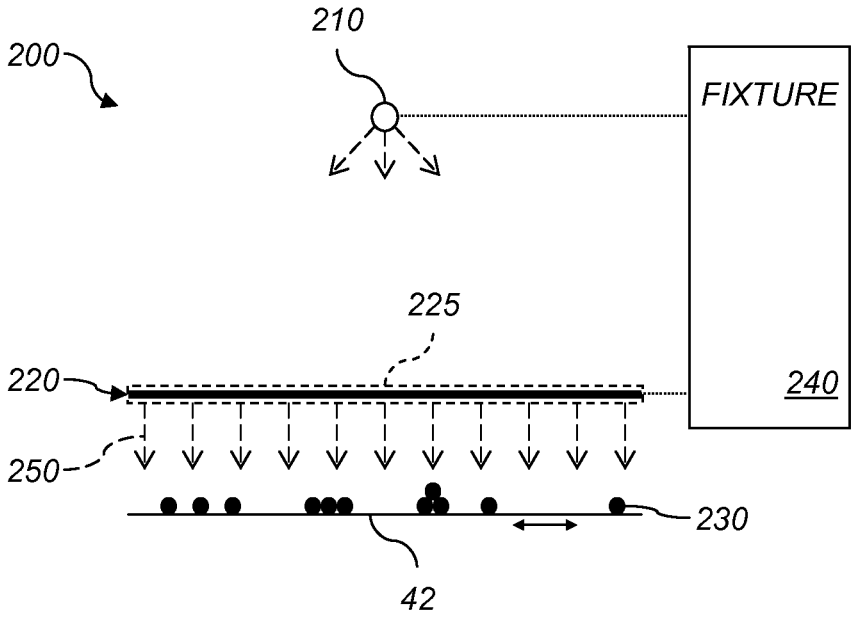
FIG. 2 is an elevational cross-section of a toner-heating apparatus according to an embodiment of the present invention.

FIG. 2 is an elevational cross-section of toner-heating apparatus 200 according to an embodiment of the present invention. Referring also to FIG. 1, apparatus 200 is preferably employed as a preheater or fuser (i.e. fuser 60) in an electrophotographic printer 100 such as that described above.

Apparatus 200 heats toner 230 on receiver 42, e.g. a piece of paper. Energy source 210 provides input energy (e.g. photons), indicated by the dashed arrows emanating from it. Membrane 220 is disposed adjacent to receiver 42, e.g. 0.5 cm-10 cm away. Membrane 220 receives the input energy from the energy source, e.g. by absorption. Membrane 220 stores a portion of the input energy, and radiates emitted energy 250 that is absorbed by toner 230, receiver 42, or a combination thereof. This absorption causes the temperature of the toner 230 to rise above a desired temperature, e.g. to preheat or fix the toner. When emitted energy is absorbed by receiver 42, heat can be carried from receiver 42 into toner 230 by conduction, or by convection of air around receiver 42 and toner 230. Membrane 220 can advantageously provide emitted energy 250 distributed more uniformly over receiver 42 than the input energy from energy source 210.

Receiver 42 has an ignition energy, as will be discussed further below with reference to FIG. 4. The portion of the input energy stored by membrane 220 is less than the ignition energy of receiver 42. That is, the membrane does not contain enough energy to cause receiver 42 to combust.

In various embodiments, membrane 220 includes surface treatment 225, e.g. paint or anodizing.

In various embodiments, apparatus 200 includes fixture 240 for holding energy source 210 and membrane 220 immobile with respect to each other. By "immobile" it is meant that energy source 210 and membrane 220 undergo no designed or intended relative motion. Energy source 210 and membrane 220 can move relative to each other due to thermal expansion and mechanical tolerances. Fixture 240 holds energy source 210 and membrane 220 an appropriate distance apart, e.g. from 1 cm to 20 cm, preferably from 1 cm to 4 cm.

Two copies of the apparatus shown can be disposed on opposite sides of a continuous-web receiver 42 to provide duplex preheating, fusing, or combinations thereof.

In an embodiment, membrane 220 is formed from stainless steel, has a thickness of less than or equal to 0.0508 mm (0.002"), and has a black surface finish corresponding to a grey body having an emissivity greater than 0.90. A "grey body" is similar to a black body but the coefficient of emission is less than unity. The wavelength emitted is solely a function of the temperature. Although grey bodies are an idealization, various surfaces can reasonably be approximated as grey bodies, and all these reasonable approximations are included in this embodiment. The black surface finish causes the membrane to behave in a way that can be predicted by the grey body equations using an emissivity of 0.90 or greater.

In various embodiments, membrane 220 is bare copper (emissivity 0.1), bare stainless steel (emissivity 0.12), bare aluminum (emissivity 0.04), alumina (emissivity 0.8), or a ceramic (emissivity e.g. 0.9). Ceramic membranes 220 preferably have a Young's modulus greater than 60 GPa. Finishes, such as high temperature black paints, can be applied. In one embodiment, NEXTEL VELVET BLACK paint (formerly made by 3M, now by Mankiewicz; emissivity 0.91) is applied to the membrane.

FIGS. 3A-3D are elevational cross-sections of alternative embodiments of the present invention. Receiver 42, membrane 220, toner 230, and fixture 240 are as shown in FIG. 2.

Figure 3A:
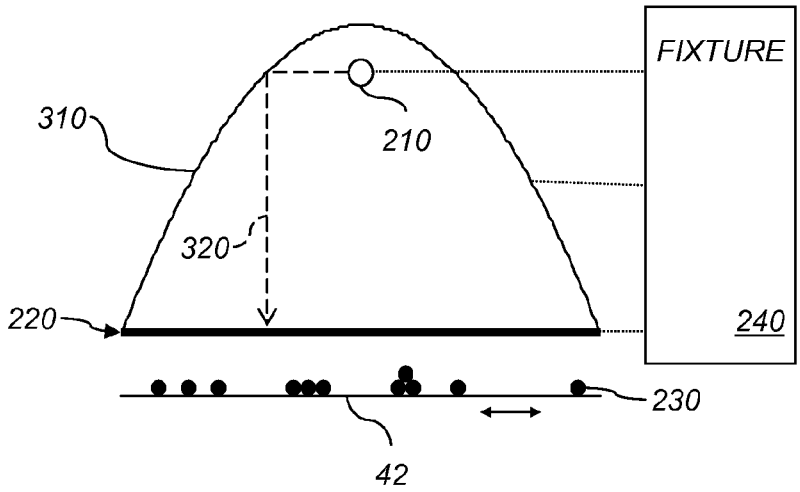
FIGS. 3A and 3B are elevational cross-sections of alternative embodiments of the present invention.

FIG. 3A shows an embodiment in which energy source 210 provides input energy by producing radiant electromagnetic energy (radiant heating). In an embodiment, energy source 210 is an argon lamp or arc lamp. Cover 310 reflects some or all of the radiant energy (e.g. ray 320, e.g. a ray of infrared or visible light) from energy source 210 onto membrane 220. Cover 310 is an example of a focusing system adapted to provide a uniform irradiance of the radiant electromagnetic energy from energy source 210 on the membrane 220. By "uniform irradiance" it is meant that the irradiance is sufficiently even across membrane 220 that the heat flow through the membrane and the incident radiant energy together maintain the temperature at any point on the membrane within ±20% of the average membrane temperature, preferably ±10%, and more preferably ±5% or ±1%. In the embodiment of FIG. 3A, the focusing system comprises cover 310, which is a parabola. In other embodiments, the focusing system can include prisms, lenses (spherical, aspherical, or Fresnel), or light pipes.

FIG. 3A is an elevational cross-section. In an embodiment, cover 310 is capped at the ends to reduce leakage of the radiant electromagnetic energy out of the focusing system. The caps can be flat or sections of paraboloids. Fixture 240 can also hold cover 310 or other elements of the focusing system in place with respect to energy source 210 and membrane 220.

Figure 3B:
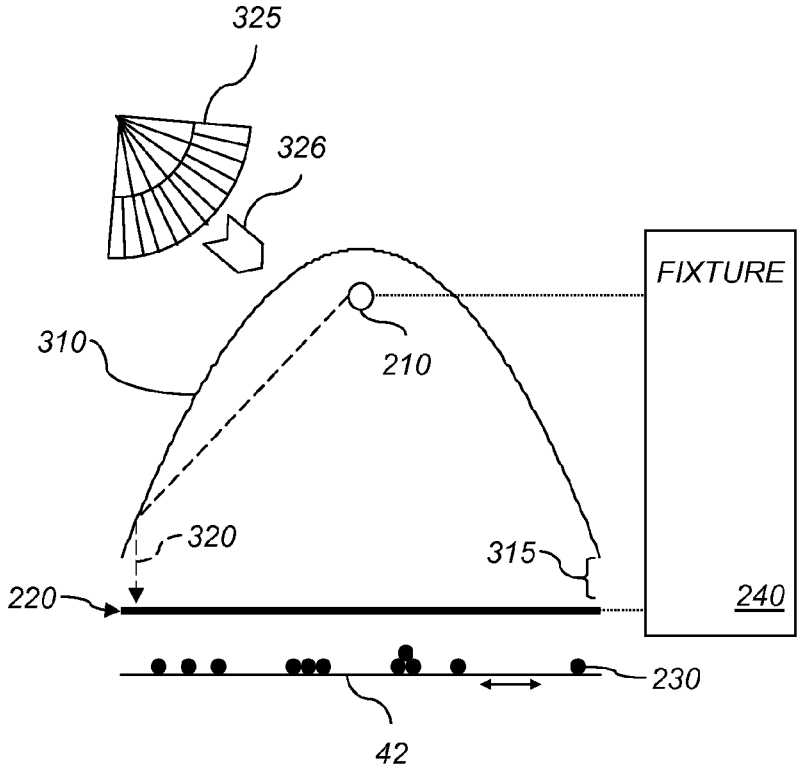

FIG. 3B shows another embodiment of the present invention. Cover 310 is spaced from energy source 210 and disposed to reflect energy from energy source 210 to membrane 220. Unlike FIG. 3A, in this embodiment there is a gap 315 between cover 310 (the focusing system) and membrane 220. Cover 310 can contact the membrane, or be spaced apart from it.

In various embodiments, cooling unit 325 is provided for cooling cover 310. In operation, cover 310 absorbs some of the incident energy (ray 320), e.g. 5%. That absorbed energy heats the cover, which in some embodiments begins to reradiate. Cooling unit 325 can be a fan (as shown schematically in FIG. 3B) for directing airflow 326 onto cover to actively cool it. Cooling unit 325 can also be a blower, thermoelectric cooler or radiator, the hot end of a Stirling motor, or another active or passive cooling system.

Figure 3C:
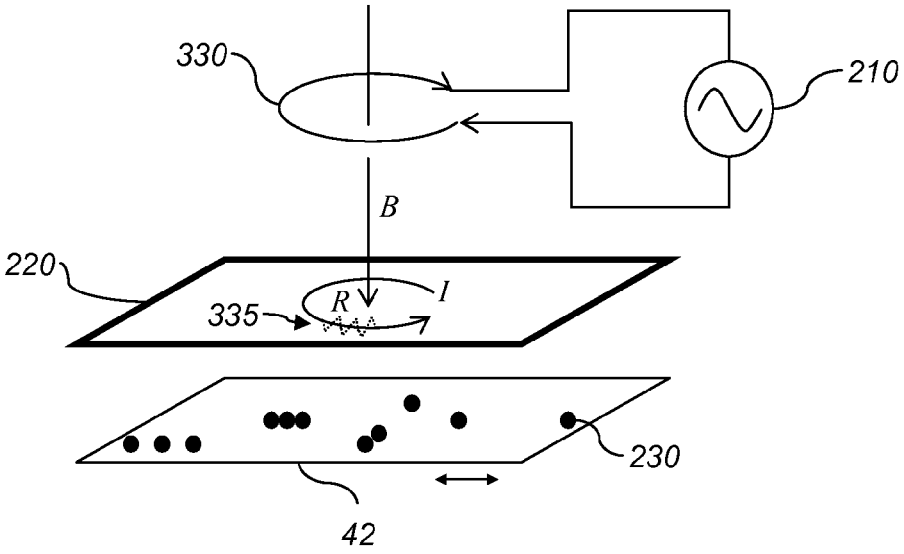
FIG. 3C is a perspective of an alternative embodiment of the present invention.

FIG. 3C shows an embodiment in which energy source 210 provides input energy by producing an alternating magnetic or electromagnetic field (inductive heating). In this embodiment, membrane 220 is of a material which experiences eddy currents in the presence of changing magnetic fields, such as a metallic conductor. Energy source 210 is an AC voltage supply that produces a time-varying potential across coil 330. The current flow through coil 330, which can have one or a plurality of turns, produces a magnetic field B. This field penetrates the surface of membrane 220 and induces eddy current I. Membrane 220 is not a perfect conductor, so it has some intrinsic resistivity. Therefore, the current path taken by eddy current I has some resistance R (shown as resistance 335). The power dissipated in this resistor, $I^2R$, is dissipated as heat into membrane 220 and causes the temperature of membrane 220 to rise.

Figure 3D:
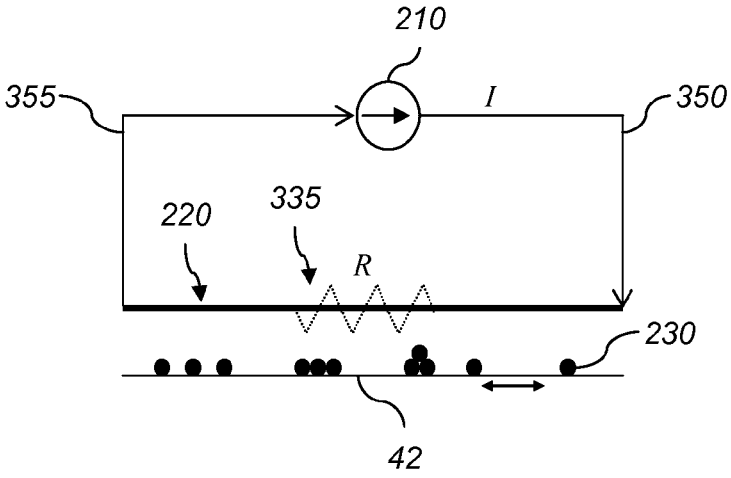
FIG. 3D is an elevational cross-section of an alternative embodiment of the present invention.

FIG. 3D shows an embodiment in which energy source 210 provides input energy by producing an electric current (resistive heating). Energy source 210 is a constant-current supply. It can also be a voltage supply, and can be AC or DC. Energy source 210 is electrically connected to membrane 220 through wires 350, 355, which can have one or more contact points of one or more sizes on membrane 220 to provide as uniform as possible a current density, or a particular distribution of current density, over membrane 220. Membrane 220 has some resistivity, so current flow I through membrane 220 encounters resistance R (shown as resistance 335), dissipating heat $I^2R$ into membrane 220 and raising its temperature. In an embodiment, membrane 220 is an electrical insulator with resistivity $>10^{14}$ Ω-cm.

In FIGS. 3C and 3D, resistance 335 is shown with a resistor symbol, but membrane 220 does not necessarily have a sawtooth shape corresponding to the shape of the symbol. Membrane 220 can be flat, or can be deformed to follow the shape of the receiver 42 as it passes through the feed path adjacent to membrane 220.

Figure 4:
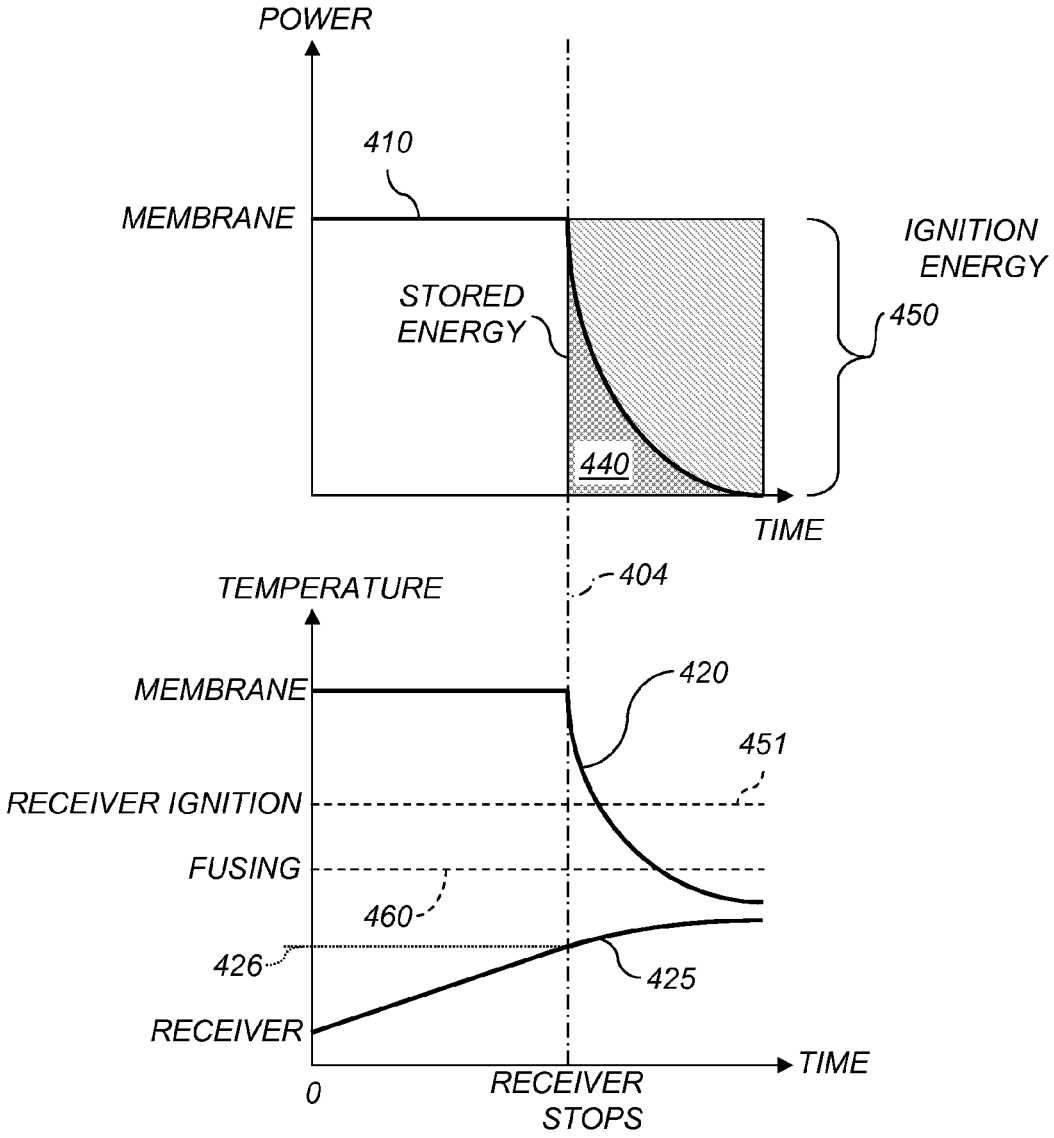
FIG. 4 is a plot of power and temperature over time, showing safety features of various embodiments of the present invention.

FIG. 4 is a plot of power and temperature over time, showing safety features of various embodiments of the present invention. The abscissa of each plot is time; the ordinates are power on the top plot and temperature on the bottom plot. At time t=0, the membrane is radiating emitted energy 250 (FIG. 2) at a constant rate, indicated by membrane power 410 (power=energy per unit time). The membrane is at a constant temperature (membrane temperature 420). The receiver temperature 425 of receiver 42 begins to rise towards a fusing temperature 460. When the temperature of the toner 230 (FIG. 2) rises above a selected threshold, e.g. fusing temperature 460, the toner 230 is fused to the receiver 42. For simplicity, in this plot the temperature of toner 230 is assumed to be the same as receiver temperature 425, but in practice toner 230 and receiver 42 can have different, though correlated, temperatures. Various embodiments of this invention can be employed as fusers, preheaters, or both.

Receiver 42 has an ignition temperature 451, typically from 225° C. to 245° C. when receiver 42 is paper. When receiver 42 reaches ignition temperature 451, it will ignite, possibly causing damage and injury. At temperatures slightly below ignition temperature 451, receiver 42 can smoke or char, producing undesirable output. In various embodiments, receiver 42 moves with respect to membrane 220 so that receiver 42 is not adjacent to membrane 220 for long enough to rise to ignition temperature 451.

In the example of FIG. 4, at stop time 404, receiver 42 stops moving with respect to membrane 220. This stop is unintentional; for example, it can be caused by bearings seizing in transport 710 (FIG. 7) or a curled receiver 42 sticking in a component of printer 100 (FIG. 1) that a flat receiver 42 does not contact. In can also be caused by a receiver jam (e.g. a paper jam) somewhere in the feed path of receiver 42. A stop at any one place in the feed path typically stops the entire feed path. Causes of jams include failure to feed properly at supply unit 40 (FIG. 1), a receiver's becoming wrapped around a roller (such as a blanket cylinder or fuser roller), or a receiver's becoming jammed against receiver handling rollers or at the marking engine output of printer 100. Receiver stoppage can also be caused by a loss of electrical power to printer 100, which deactivates all systems in printer 100.

When the receiver stops, energy source 210 (FIG. 2) is deactivated, as will be discussed further below with reference to FIG. 7. Membrane power 410 therefore decays to zero. The portion of the input energy stored in membrane 220 at stop time 404 is the integral of membrane power 410 from stop time 404 to the time when membrane power 410 drops to zero, which is stored energy 440. Due to the radiation by membrane 220, receiver temperature 425 rises a small amount after stop time 404. However, receiver temperature 425 does not rise to or near ignition temperature 451, so receiver 42 does not smoke, char or combust, advantageously reducing the probability of equipment damage, and providing increased safety to operators of an apparatus according to the present invention, or a machine, e.g. an EP printer, including the apparatus.

Receiver temperature 425 does not rise to or near ignition temperature 451 because the membrane does not store enough energy to cause it to do so. Ignition energy 450 shows the energy required at stop time 404 to raise receiver 42 from its temperature 426 at stop time 404 to its ignition temperature 451. Ignition energy 450 is a rectangle fully enclosing, and greater in area than, stored energy 440. Stored energy 440 therefore cannot bring receiver 42 up to ignition temperature 451. Membrane 220 is designed, e.g. by varying its thickness and volumetric heat capacity as known in the art, to store an amount of energy less than the ignition energy of receiver 42 under typical conditions, and preferably under extreme conditions. For example, fusing temperature 460 can be 200° C., and ignition temperature 451 can be 230° C. In extremely hot environments, receiver temperature 425 can be as high as 215° C. in normal operation. Membrane 220 is therefore designed to store less energy than that required to raise the temperature of the membrane 15° C. Membrane 220 is preferably designed to store less energy than the minimum ignition energy over the life of membrane 220, taking into account any age-related changes in emissivity or specific heat of membrane 220 due to e.g. contamination or particle accretion on membrane 220 (e.g. dust settling). This advantageously provides the same level of safety over the whole service life of membrane 220.

In various embodiments, stored energy 440 raises receiver temperature 425 above fusing temperature 460, but not to ignition temperature 451. In another embodiment, stored energy 440 raises receiver temperature 425 to or above ignition temperature 451, but receiver 42 cools fast enough that it does not ignite. One skilled in the art can readily calculate the rate of heat loss of receiver 42 to its environment and determine what temperature can be tolerated for a certain amount of time, or how much time receiver 42 can spend above ignition temperature 451 before combusting.

Figure 5A:
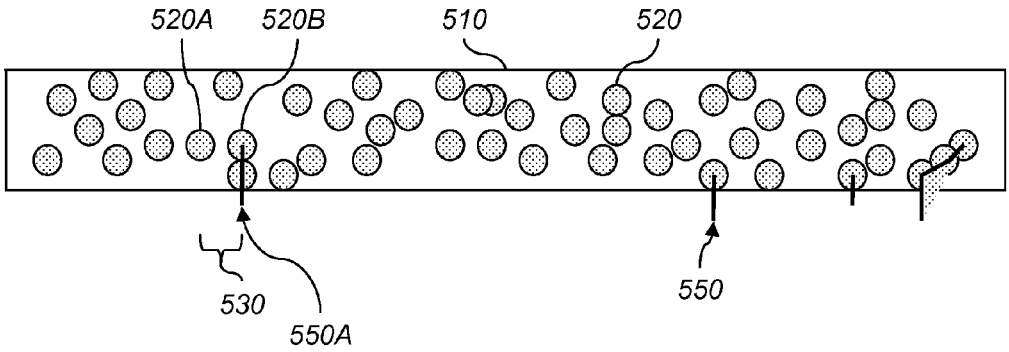
FIG. 5A is a representative elevational cross-section of a matrix containing ceramic particles.

FIG. 5A shows a representative elevational cross-section of a matrix 510, e.g. a flexible polymer or a metal, containing ceramic particles 520. Ceramic particles 520 have a Young's modulus greater than 60 GPa, and preferably $\sim 10^{11}$ Pa. The ceramic can be a high-modulus material such as quartz, sapphire, diamond, diamond-like carbon (DLC), or carborundum. The ceramic is preferably not calcite, gypsum, or talc. In this example, the distance 530 between two adjacent ceramic particles 520A, 520B is large enough that phonons cannot travel between the particles on phonon path 550A; they are blocked by the material of matrix 510. The same is true of phonon path 550. Phonons therefore cannot pass through matrix 510.

In this example, the concentration of ceramic particles 520 in matrix 510 is below the percolation threshold. At this concentration, there are few, if any, paths that permit phonons to traverse the width of matrix 510.

Figure 5B:
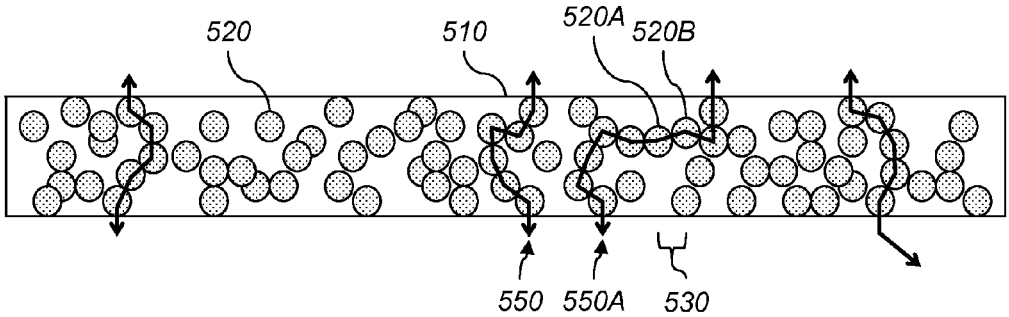
FIG. 5B is a representative elevational cross-section of a membrane containing ceramic particles according to an embodiment of the present invention.

FIG. 5B is a representative elevational cross-section of membrane 220 (FIG. 2) containing ceramic particles 520 according to an embodiment of the present invention. Membrane 220 includes matrix 510 and ceramic particles 520 as described above. In this example, the distance 530 between two adjacent ceramic particles 520A, 520B is small enough that phonons can travel between the particles on phonon path 550A. The same is true of phonon path 550. Phonons therefore can pass through matrix 510, so energy can be transferred through matrix 510 and membrane 220 to heat toner 230. Matrix 510 preferably has ≧30% by volume ceramic particles 520. In this embodiment, there are conduction paths through the polymer matrix for phonons to travel from one ceramic particle to the next. Specifically, membrane 220 includes a plurality of ceramic particles 520 in matrix 510, and the ceramic particles 520 are spaced closely enough to permit phonons to travel between them. The average spacing between ceramic particles 520 in matrix 510 is preferably less than or equal to the mean diameter of the ceramic particles ("diameter" refers to the volume-weighted median diameter, as determined by a device such as a Coulter Multisizer).

Figure 6:
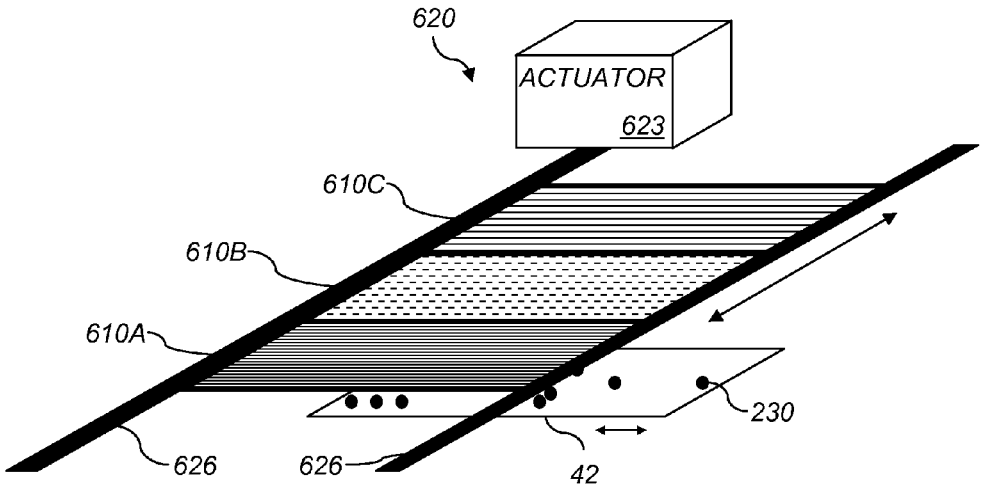
FIG. 6 is a perspective of an embodiment of the present invention using multiple membrane segments.

FIG. 6 shows a perspective of an embodiment of the present invention using multiple membrane segments. Receiver 42 and toner 230 are as shown on FIG. 2. Membrane 220 (FIG. 2) includes a plurality of membrane segments 610A, 610B, 610C attached edge-to-edge, either held flat or wrapped on a roll, with a motor or solenoid to move the segments into the path between the energy source and the receiver. Each membrane segment 610A, B, C differs from the other membrane segments in at least one of surface treatment, thickness, membrane material, emissivity, or coating. Different surface treatments can vary the membrane emissivity from 0.90 to 0.95. Membrane thickness is between 25 μm and 125 μm, preferably 50 μm. Membrane materials can include carbon steel, aluminum, or preferably stainless steel.

Fixture 240 (FIG. 2) holds energy source 210 (FIG. 2) and membrane 220. Fixture 240 includes membrane transport 620 for moving the membrane 220 so that a selected membrane segment 610A, B, C is disposed between energy source 210 and receiver 42. This advantageously permits varying the heating or fusing characteristics of the apparatus in a safe and automated way that requires no manual intervention.

In an embodiment, membrane transport 620 includes two rails 626 on which membrane segments 610A, B, C ride. Actuator 623 moves the rails 626 to position the selected membrane segment 610A, B, C appropriately. In other embodiments (not shown), membrane 220 is a belt or continuous loop entrained around rollers driven by motors (e.g. servomotors). In another embodiment, membrane 220 is a disk with the membrane segments arranged around the perimeter of the disk. Membrane transport 620 rotates membrane 220 into position.

Figure 7:
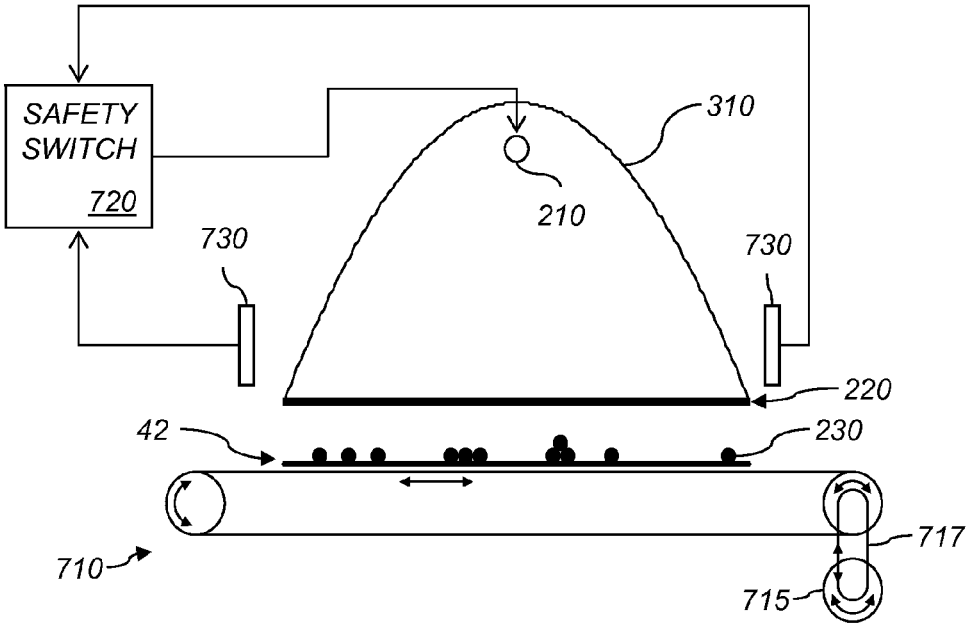
FIG. 7 is an elevational cross-section of a heating apparatus with safety features according to an embodiment of the present invention.

FIG. 7 is an elevational cross-section of a heating apparatus with safety features according to an embodiment of the present invention. Energy source 210, membrane 220, receiver 42, and toner 230 are as shown on FIG. 2. Cover 310 is as shown on FIG. 3. Transport 710 moves receiver 42 relative to membrane 220. Transport 710 is shown here as a belt driven through belt 717 by motor 715, but can also be a linear slide or other mechanism known in the art. The present invention can also be employed with continuous web receivers 42, in which receiver 42 is entrained around tensioning and drive rollers, and serves as its own support. Safety switch 720 detects stoppage of the transport or of receiver 42 and, in response to the stoppage, causes energy source 210 to stop providing input energy to membrane 220.

In an embodiment, sensor 730 detects the lead or trail edge of receiver 42 as it passes under sensor 730 into, or out of, the area under membrane 220. Safety switch includes timing data describing when an edge of receiver 42 is expected to arrive at the sensor. If receiver 42 fails to arrive at the expected time, or remains in position longer than the expected time, safety switch 720 reports an error to the operator, stops transport 710, and deactivates or removes power to energy source 210. The time from sheet error to power cutoff is preferably less than one second.

In another embodiment, safety switch 720 receives information from an encoder on transport 710 about the motion of receiver 42. This information is used analogously to the data from sensor 730.

In the event of a total power loss to printer 100 (FIG. 1) or another device including apparatus 200 (FIG. 2), the power and temperature curves will follow FIG. 4 as if a shutdown had been directed by safety switch 720. Power to energy source 210 (FIG. 2) will be removed and the stored and thermal energy of the system will dissipate safely. Energy source 210 is preferably designed so that the stored energy 440 in membrane 220, plus any stored energy capable of being supplied to energy source 210, e.g. by a capacitor or flywheel, is less than ignition energy 450.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
40 supply unit
42 receiver
50 transfer subsystem
60 fuser
62 fusing roller
64 pressure roller
66 fusing nip
68 release fluid application substation
69 output tray
99 logic and control unit (LCU)
100 printer
101 transport web
106 cleaning station
200 apparatus
210 energy source
220 membrane

225 surface treatment
230 toner
240 fixture
250 emitted energy
310 cover
315 gap
320 ray
325 cooling unit
326 airflow
330 coil
335 resistance
350, 355 wire
404 stop time
410 membrane power
420 membrane temperature
425 receiver temperature
426 temperature
440 stored energy
450 ignition energy
451 ignition temperature
460 fusing temperature
510 matrix
520, 520A, 520B ceramic particle
530 distance
550, 550A phonon path
610A, 610B, 610C segment
620 membrane transport
623 actuator
626 rail
710 transport
715 motor
717 belt
720 safety switch
730 sensor
B magnetic field
I eddy current
R resistance

What is claimed is:

1. Apparatus for heating toner on a receiver having an ignition energy, comprising:

a. an energy source for providing input energy;

b. a membrane disposed adjacent to the receiver and adapted to:

i. receive the input energy from the energy source;

ii. store a portion of the input energy, wherein the stored portion of the input energy is less than the ignition energy; and iii. radiate emitted energy that is absorbed by the toner, the receiver, or a combination thereof, wherein the absorption causes the temperature of the toner to rise above a desired temperature;

c. wherein the membrane comprises a plurality of segments, each of the plurality of segments differing from the other segments in at least one of surface treatment, thickness, membrane material, emissivity, or radiation emissive output; and d. a fixture for holding the energy source and the membrane, including a membrane transport for moving the membrane so that a selected segment is disposed between the energy source and the receiver.

2. The apparatus according to claim 1, wherein the temperature of the toner rises above a selected threshold, so that the toner is fused to the receiver.

3. The apparatus according to claim 1, wherein the energy source produces radiant electromagnetic energy, further including a focusing system adapted to provide a uniform irradiance on the membrane of the radiant electromagnetic energy.

* * * * *